United States Patent [19]

Hirai et al.

[11] Patent Number: 4,590,154

[45] Date of Patent: May 20, 1986

[54] HEAT DEVELOPABLE COLOR PHOTOGRAPHIC LIGHT-SENSITIVE MATERIAL CONTAINING SULFONAMIDE

[75] Inventors: Hiroyuki Hirai; Yoshiharu Yabuki; Masashi Takeuchi; Toshiaki Aono, all of Kanagawa, Japan

[73] Assignee: Fuji Photo Film Co., Ltd., Kanagawa, Japan

[21] Appl. No.: 730,925

[22] Filed: May 6, 1985

[30] Foreign Application Priority Data

May 4, 1985 [JP] Japan ..... 59-89624

[51] Int. Cl.[4] ..... G03C 1/40; G03C 5/54

[52] U.S. Cl. ..... 430/559; 430/203; 430/218; 430/351; 430/487; 430/617

[58] Field of Search ..... 430/203, 218, 351, 617, 430/619, 620, 487, 559

[56] References Cited

U.S. PATENT DOCUMENTS

| | | | |
|---|---|---|---|
| 3,305,364 | 2/1967 | Bard et al. | 430/483 |
| 4,463,079 | 7/1984 | Naito et al. | 430/203 |
| 4,473,631 | 9/1984 | Hirai et al. | 430/203 |

*Primary Examiner*—Richard C. Schilling

*Attorney, Agent, or Firm*—Sughrue, Mion, Zinn, Macpeak & Seas

[57] ABSTRACT

A heat developable color photographic light-sensitive material is described, comprising (1) a light-sensitive silver halide, (2) a hydrophilic binder, (3) a dye releasing compound having an ability to reduce exposed light-sensitive silver halide and capable of reacting with the exposed silver halide upon heating, thereby releasing a mobile dye, and (4) a sulfonamide compound represented by the formula $$R_0—SO_2NH_2$$

wherein $R_0$ represents an alkyl group, an alkenyl group, an alkynyl group containing at least 4 carbon atoms, an aralkyl group, an aryl group or a heterocyclic ring group, provided that the heterocyclic ring group is linked to $—SO_2NH_2$ through a carbon atom contained in the ring thereof.

6 Claims, No Drawings

HEAT DEVELOPABLE COLOR PHOTOGRAPHIC LIGHT-SENSITIVE MATERIAL CONTAINING SULFONAMIDE

FIELD OF THE INVENTION

The present invention relates to a heat developable color photographic light-sensitive material, i.e., a photographic light-sensitive material forming color images upon heat development.

BACKGROUND OF THE INVENTION

Heat developable photographic light-sensitive materials and a process for forming images using the materials are well known and are described in detail, for example, in *Shashin Kogaku no Kiso* (*Fundamentals of Photographic Engineering*), Corona Co., Ltd., Tokyo, pp. 553–555 (1979), *Eizo Joho* (*Image Information*), April, 1978, p. 40, and *Neblette's Handbook of Photography and Reprography,* 7th Ed., Van Nostrand Reinhold Company, pp. 32–33, 1977. For the formation of, in particular, color images, various techniques have been proposed, including a method in which couplers are used as dye releasing compounds (see U.S. Pat. Nos. 3,531,286, 3,761,270, 4,021,240, Belgian Pat. No. 802,519, and *Research Disclosure,* September, 1975, pp. 31–32), a method in which compounds with a nitrogen-containing heterocyclic ring group introduced in the dye portion are used as dye releasing compounds (see *Research Disclosure,* May, 1978, pp. 54–58), a method utilizing the silver dye bleaching process (see *Research Disclosure,* April 1976, pp. 30–32, ibid., December, 1976, pp. 14–15, and U.S. Pat. No. 4,235,957), and a method utilizing leuco dyes (see U.S. Pat. Nos. 3,985,565 and 4,022,617).

These methods, however, have their respective disadvantages. Their common disadvantages are that the development requires relatively long periods of time, images formed have undesirably high fog levels, and on the contrary, the maximum density ($D_{max}$) is low.

In order to overcome the above problems, U.S. Pat. No. 4, 500,626 discloses a method using dye releasing redox compounds which release hydrophilic dyes. Although this method has succeeded in ameliorating the above disadvantages, it has been desired to obtain a light-sensitive material which can be heat developed at relatively low temperatures, and in short periods of time, and in which a high maximum density can be obtained while preventing the formation of fog.

SUMMARY OF THE INVENTION

An object of the present invention is to provide a heat developable color photographic light-sensitive material in which a maximum density as high as possible can be obtained while preventing the formation of fog by heat development at relatively low heating temperatures, and for short periods of time.

Accordingly, the present invention relates to a heat developable color photographic light-sensitive material comprising (1) a light-sensitive silver halide, (2) a hydrophilic binder, (3) a dye releasing compound which is capable of reducing exposed light-sensitive silver halide and reacts with the exposed silver halide upon heating, thereby releasing a mobile dye, and (4) a sulfonamide compound represented by the formula ($I_0$)

$$R_0—SO_2NH_2 \qquad (I_0)$$

wherein $R_0$ represents an alkyl group, an alkenyl group, an alkynyl group containing at least 4 carbon atoms, an aralkyl group, an aryl group, or a heterocyclic ring group, provided that the heterocyclic ring group is linked to $—SO_2NH_2$ through a carbon atom contained in the ring thereof.

It is to be understood that the groups represented by $R_0$ as defined above include substituted groups, as is described in more detail below.

DETAILED DESCRIPTION OF THE INVENTION

The light-sensitive material of the present invention can produce color images having a high maximum density with decreased fog even when heat developed at relatively low temperatures, and for short periods of time. This is due to the use of the above-noted sulfonamide compounds. That is, these sulfonamide compounds are very effective as development accelerators. Another advantage of the sulfonamide compounds is that they are not scattered even if heated at relatively high temperatures. Thus, when used in the light-sensitive material, they can be utilized efficiently without loss and moreover they do not cause a problem of damage of a heat developing apparatus due to scattering.

The sulfonamide compounds represented by the above formula are hereinafter described in more detail.

The alkyl group may be straight or branched. The term "alkyl" as used herein includes alos a cycloalkyl group. Suitable examples of the alkyl group are a butyl group, an isobutyl group, a cyclohexyl group, a heptyl group, an octyl group, and a dodecyl group. Suitable examples of substituents in the substituted alkyl groups include an alkoxyl group (for example, a methoxy group), a hydroxyl group, a cyano group, a halogen atom, and a sulfonamido group.

Suitable examples of the aryl group are a phenyl group and a naphthyl group. Suitable examples of substituents for the substituted aryl group include an alkyl group (e.g., a methyl group and a dodecyl group), a cyano group, a nitro group, an amino group, an acylamino group, a sulfonamido group (including both aliphatic and aromatic groups, and also those groups containing a heterocyclic group), an alkoxyl group, an aryloxyl group, an alkoxycarbamoyl group, a ureido group, a carbamoyl group, an acyloxy group, a 5- or 6-membered heterocyclic group (preferably containing a nitrogen atom), an alkylsulfonyl group, a carboxylic acid group, a sulfonic acid group, a sulfamoyl group, and a halogen atom (e.g., fluorone, bromine, chlorine, and iodine). These substituents bonding to an aryl group can have a substituent or substituents (two or more substituents).

The above substituents bonding to an aryl group can be applied as substituents for the following groups.

Preferred examples of the aralkyl group are a benzyl group and a phenethyl group.

The heterocyclic ring group is preferred to be 5- or 6-membered and to contain at least a nitrogen, oxygen, or sulfur atom. Representative examples include a furan ring residue, a thiophene ring residue, a pyridine ring residue, a quinoline ring residue, a thiazole ring residue, and a benzothiazole ring residue. That is, the heterocyclic ring group may be a single ring or a condensed ring.

Of the sulfonamide compounds represented by the formula $R_0$—$SO_2NH_2$, those compounds in which $R_0$ is a phenyl group or a substituted phenyl group are preferred.

Representative examples of the sulfonamide compounds are shown below.

(1)

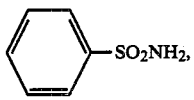

(2)

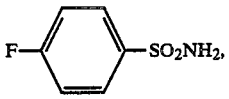

(3)

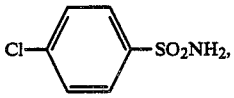

(4)

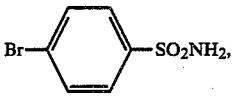

(5)

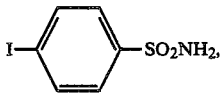

(6)

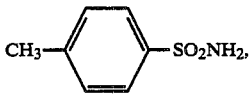

(7)

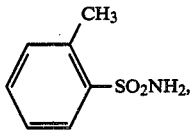

(8)

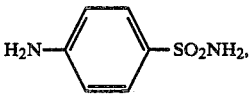

(9)

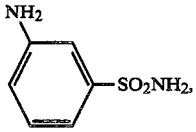

-continued (10)

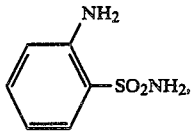

(11)

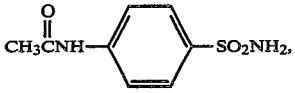

(12)

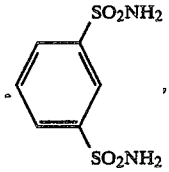

(13)

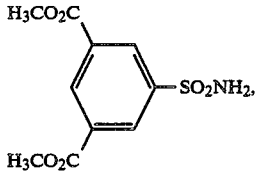

(14)

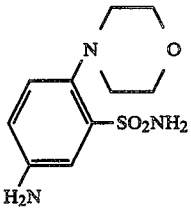

(15)

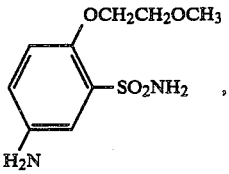

(16)

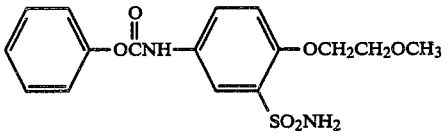

(17)

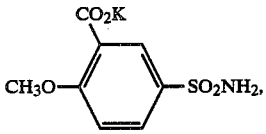

(18)

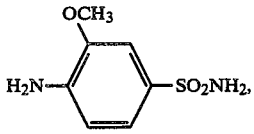

(19)

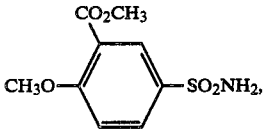

-continued
(20)
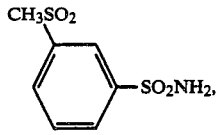
(21)
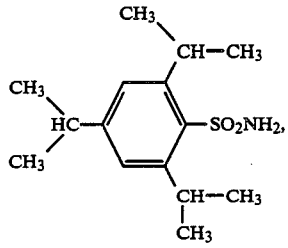
(22)
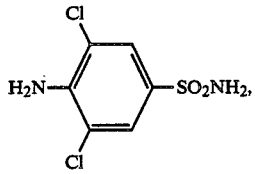
(23)
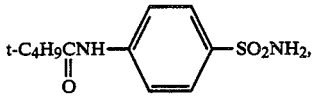
(24)
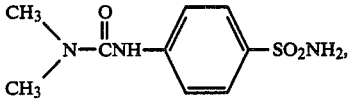
(25)
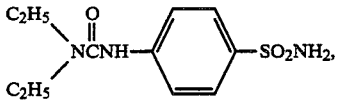
(26)
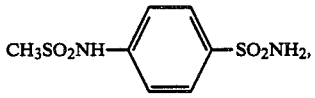
(27)
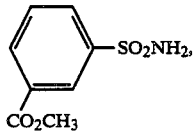
(28)
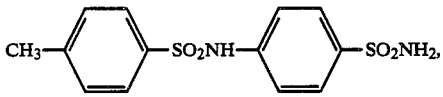
(29)
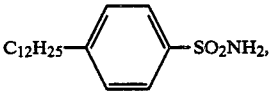
(30)
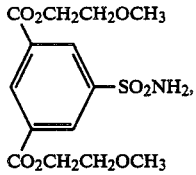
-continued
(31)
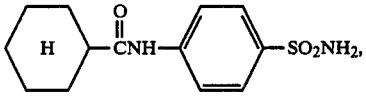
(32)
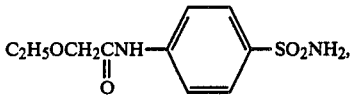
(33)
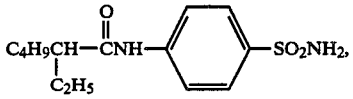
(34)
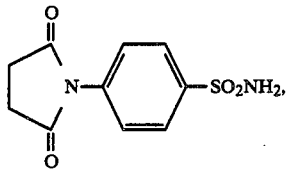
(35)
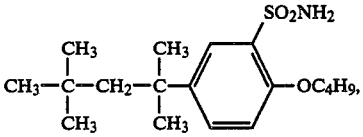
(36)
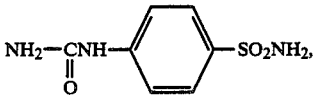
(37)
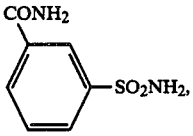
(38)
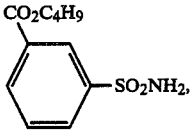
(39)
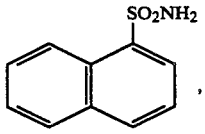
(40)
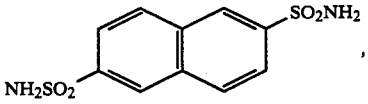
(41)
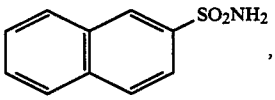
(42)
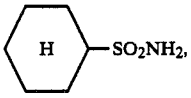
(43)
$C_8H_{17}SO_2NH_2$, -continued (44)

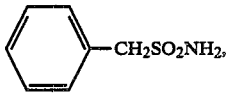

(45)

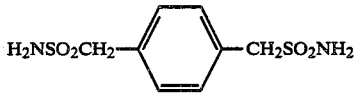

(46)

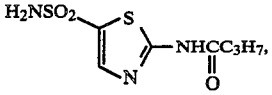

(47)

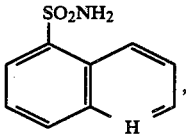

(48)

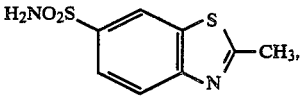

(49)

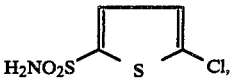

(50)

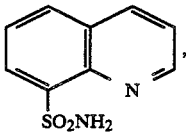

(51)

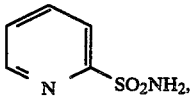

(52)

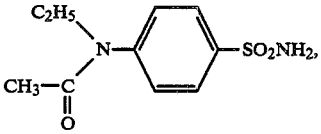

(53)

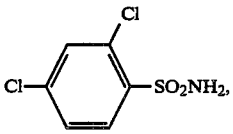

(54)

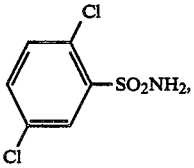

(55)

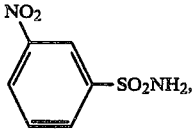

-continued (56)

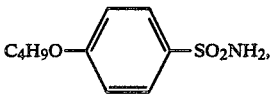

(57)

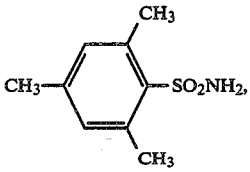

(58) $C_7H_{15}SO_2NH_2$,

(59) $C_{12}H_{25}SO_2NH_2$,

(60) $H_2NSO_2—(CH_2)_4—SO_2NH_2$, (61)

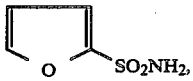

(62)

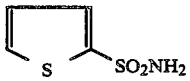

These sulfonamide compounds are known compounds and can be easily prepared by reacting the corresponding sulfonyl chlorides with ammonia in water or acetonitrile. These sulfonyl chlorides can also be easily prepared by procedures such as a method of reacting the corresponding sulfonic acids with a chlorination agent such as phosphorus oxychloride, thionyl chloride, and phosphorus pentachloride, a method of directly chlorosulfonating reaction with chlorosulfonic acid, and a method of reacting the corresponding thiols with disulfide and chlorine.

Preparation examples of two typical compounds are given below.

PREPARATION EXAMPLE 1

Preparation of 3,5-Bis(methoxycarbonyl)benzenesulfonamide (Compound (13))

In a mixed solvent of 300 ml of acetonitrile and 100 ml of dimethylformamide (DMF) was suspended 100 g of sodium 3,5-bis(methoxycarbonyl)benzenesulfonate, and 100 ml of phosphorus oxychloride was added dropwise to the resulting suspension while maintaining it at 60° C. or less. The mixture was stirred at 60° C. for 3 hours and then the acetonitrile was distilled away. The residue was poured into ice water, and crystals precipitated were filtered off and dried (yield, 97.5 g).

These crystals were reacted with ammonia at 15° to 20° C. in 600 ml of acetonitrile, and then the thus formed crystals were filtered off and washed with 1 l of water. They were recrystallized from a mixture solvent of a methanol/water (10/1) to yield 86 g of 3,5-bis(methoxycarbonyl)benzenesulfonamide (m.p. 148°–150° C.).

PREPARATION EXAMPLE 2

Preparation of p-Pivaloylaminobenzenesulfonamide (Compound (23))

To a mixture of 200 ml of acetonitrile, 50 g of sulfanilamide, and 30 g of triethylamine was added dropwise 35 g of pivaloyl chloride at 50° C. They were then stirred for 30 minutes and the resulting suspension was poured into 1.5 l of water. The thus formed crystals were separated by filtration to yield 68 g of p-pivaloylaminobenzenesulfonamide (m.p., 219°–220° C.).

The other compounds can be prepared by similar methods to those of Preparation Examples 1 and 2.

The sulfonamide compounds of the present invention are used as solutions dissolved in organic solvents such as alcohols (e.g., methanol and ethanol), methyl cellosolve, and methylformamide.

The sulfonamide compounds of the present invention are incorporated in a suitable layer of the light-sensitive material. It is preferred that the sulfonamide compounds be incorporated in a layer containing light-sensitive silver halide or in a layer adjacent thereto.

The sulfonamide compounds of the present invention can be used singly or as mixtures comprising two or more thereof. In addition, they may be used in combination with polyethylene glycol type nonionic surface active agents as described in Japanese Patent Application (OPI) No. 57234/84 (the term "OPI" as used herein refers to a "published unexamined Japanese patent application open to public inspection") and/or pyridinium group-containing cationic compounds as described in Japanese Patent Application (OPI) No. 74547/84.

The sulfonamide compounds of the present invention can be used in varied amounts. The amount of the sulfonamide compounds used is not particularly limited, but is generally used in a range of from 1/100 to 10 mols, and preferably from 1/20 to 2 mols, per mol of silver.

Upon heat development after imagewise exposure of the light-sensitive material of the present invention, a silver image having a negative/positive relationship with the original and a mobile dye are simultaneously formed in exposed areas.

In one embodiment of the present invention, when the light-sensitive material is exposed imagewise and heat developed, exposed light-sensitive silver halide and the reducing dye releasing compound undergo an oxidation reduction reaction (i.e., redox reaction), thereby forming a silver image in exposed areas. Simultaneously the dye releasing compound is oxidized by the silver halide and converted into an oxidation product. The sulfonamide compounds accelerate the redox reaction between the silver halide and the dye releasing compound. It is believed, therefore, that by use of the sulfonamide compounds, the mobile dye is released more efficiently. Accordingly both the silver image and the mobile dye are formed in the exposed areas. The thus formed mobile dye is transferred to a suitable substrate, whereupon the desired color image is formed.

When the sulfonamide compounds of the present invention are used, compounds listed below as preferred examples exhibit particularly high reactivity although it varies with the type of the dye releasing compound. This high reactivity is an unexpected discovery. The above-described dye releasing compounds can undergo a redox reaction with silver halide without the aid of socalled auxiliary developing agents. These unexpected results cannot be found from a conventional skill at temperatures near ordinary room temperature (i.e., from about 20° C. to 40° C.).

The above-noted redox reaction proceeds well particularly in the presence of organic silver salt oxidizing agents to obtain high density. For this reason, it is particularly preferred that such organic silver salt oxidizing agents be used in combination with the sulfonamide compounds.

Preferred examples of the dye releasing redox compounds releasing a hydrophilic mobile dye which are used in the present invention are compounds represented by formula (I)

$$R—SO_2—D \qquad (I)$$

wherein R represents a reducing group which cleaves in a negative or positive relation to an imagewise exposed silver halide, i.e., to a latent image, thereby releasing a dye having the mobility different from that of the dye releasing compound, and D is an image forming dye (including a precursor thereof) portion which is mobile when released; it also includes a bonding group connecting a "pure" dye portion with $—SO_2—$).

The reducing group R of the dye releasing compound represented by formula (I) preferably has an oxidation reduction potential (as determined by a polarograph half wave potential measuring method with acetonitrile as a solvent and sodium perchlorate as a supporting electrolyte, and indicated in relation to a saturated calomel electrode) of 1.2 volts or less.

Representative examples of the reducing base portion R are described in U.S. Pat. No. 4,500,626, columns 3–12. Particularly preferred are groups represented by formula (II)

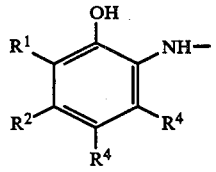

(II)

wherein $R^1$, $R^2$, $R^3$ and $R^4$ each represents a hydrogen atom, an alkyl group, a cycloalkyl group, an aryl group, an alkoxyl group, an aryloxy group, an aralkyl group, an acyl group, an acylamino group, an alkylsulfonylamino group, an arylsulfonylamino group, an aryloxyalkyl group, an alkoxyalkyl group, an N-substituted carbamoyl group, and N-substituted sulfamoyl group, a halogen atom, an alkylthio group, or an arylthio group, and the alkyl or aryl moiety of these groups may be substituted with an alkoxyl group, a halogen atom, a hydroxyl group, a cyano group, an acyl group, an acylamino group, a substituted carbamoyl group, a substituted sulfamoyl group, an alkylsulfonylamino group, an arylsulfonylamino group, a substituted ureido group, or a carboalkoxyl group.

The hydroxyl and amino groups of the reducing group R may be protected by a protective group capable of reproducing the hydroxyl group and the amino group by the action of nucleophilic reagents.

More preferred examples of the reducing group R are groups represented by formula (III)

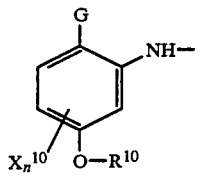
(III)

wherein G represents a hydroxyl group or a group providing a hydroxyl group upon hydrolysis, $R^{10}$ represents an alkyl group or an aromatic group, and $X^{10}$ represents an electron releasing substituent when n=1 and, when n=2 or 3, the $X^{10}$ groups may be the same or different; when one is an electron releasing group, the second or third substituent is an electron releasing group or a halogen atom, and $X^{10}$ may form a condensed ring by itself or in combination with $OR^{10}$. The total number of carbon atom in $R^{10}$ and $X^{10}$ is 8 or more.

More preferred examples of the groups represented by formula (III) are groups represented by formulae (IIIa) and (IIIb)

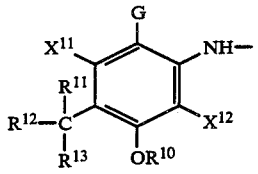
(IIIa)

wherein G represents a hydroxyl group or a group providing a hydroxyl group upon hydrolysis, $R^{11}$ and $R^{12}$ may be the same or different, and each represents an alkyl group, and may combine with each other to form a ring, $R^{13}$ represents a hydrogen atom or an alkyl group, $R^{10}$ represents an alkyl group or an aromatic group, and $X^{11}$ and $X^{12}$ may be the same or different, and each represents a hydrogen atom, an alkyl group, an alkyloxy group, a halogen atom, an acylamino group, or an alkylthio group, and $R^{10}$ and $X^{12}$, or $R^{10}$ and $R^{13}$ can combine together to form a ring;

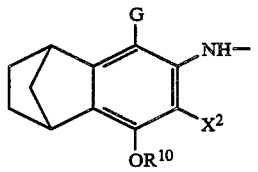
(IIIb)

wherein G represents a hydroxyl group or a group providing a hydroxyl group upon hydrolysis, $R^{10}$ represents an alkyl group or an aromatic group, and $X^2$ represents a hydrogen atom, an alkyl group, an alkyloxy group, a halogen atom, an acylamino group, or an alkylthio group, and $X^2$ and $R^{10}$ can combine together to form a ring.

Representative examples of the groups represented by formulae (III), (IIIa), and (IIIb) are described in U.S. Pat. No. 4,055,428, and Japanese Patent Application (OPI) Nos. 12642/81 and 16130/81.

More preferred examples of the reducing group R are groups represented by formula (IV)

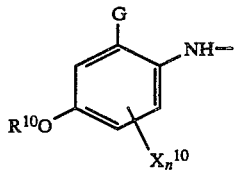
(IV)

wherein G, $X^{10}$, $X^{10}$ and n are the same as defined for formula (III).

More preferred examples of the groups represented by formula (IV) are groups represented by formulae (IVa) to (IVc)

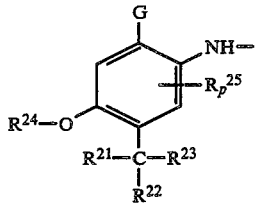
(IVa)

wherein G represents a hydroxyl group or a group providing a hydroxyl group upon hydrolysis, $R^{21}$ and $R^{22}$ can be the same or different, and each represents an alkyl group or an aromatic group, and can combine with each other to form a ring, $R^{25}$ represents a hydrogen atom, an alkyl group, or an aromatic group, $R^{24}$ represents an alkyl group or an aromatic group, $R^{25}$ represents an alkyl group, an alkoxyl group, an alkylthio group, an arylthio group, a halogen atom, or an acylamino group, and p is 0, 1 or 2, $R^{24}$ and $R^{25}$ can combine together to form a condensed ring, $R^{21}$ and $R^{24}$ can combine together to form a condensed ring, $R^{21}$ and $R^{25}$ can combine together to form a condensed ring, and the total number of carbon atoms in $R^{21}$, $R^{22}$, $R^{23}$, $R^{24}$ and $R_p^{25}$ is from 7 to 40;

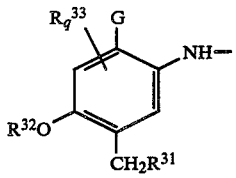
(IVb)

wherein G represents a hydroxyl group or a group providing a hydroxyl group upon hydrolysis, $R^{31}$ represents an alkyl group or an aromatic group, $R^{32}$ represents an alkyl group or an aromatic group, $R^{33}$ represents an alkyl group, an alkoxyl group, an alkylthio group, an arylthio group, a halogen atom, or an acylamino group, q is 0, 1 or 2, $R^{32}$ and $R^{33}$ can combine together to form a condensed ring, $R^{31}$ and $R^{32}$ can combine together to form a condensed ring, $R^{31}$ and $R^{33}$ can combine together to form a condensed ring, and the total number of carbon atoms in $R^{31}$, $R^{32}$ and $R_q^{33}$ is from 7 to 40; and (IVc)

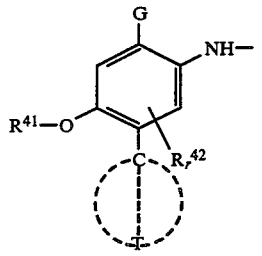

wherein G represents a hydroxyl group or a group providing a hydroxyl group upon hydrolysis, $R^{41}$ represents an alkyl group or an aromatic group, $R^{42}$ represents an alkyl group, an alkoxyl group, an alkylthio group, an arylthio group, a halogen atom, or an acylamino group, r is 0, 1 or 2, the group

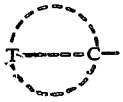

is a group obtained by condensation of from 2 to 4 saturated hydrocarbon rings, in which the carbon atom

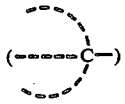

of the condensed ring participating in its bonding to the phenol (or its precursor) nucleus of formula (IVc) is a tertiary carbon atom, part of the carbon atom (excluding the above tertiary carbon atom) of the hydrocarbon ring may be substituted with an oxygen atom, and the hydrocarbons may be substituted or may be condensed to an aromatic ring, and $R^{41}$ or $R^{42}$ and the group

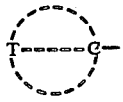

may combine together to form a condensed ring, provided that the total number of carbon atoms in $R^{41}$, $R_r^{42}$, and the group

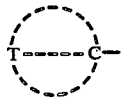

is from 7 to 40.

Preferred examples of R are shown below.

(R-1)

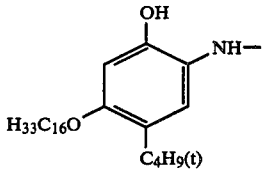

(R-2)

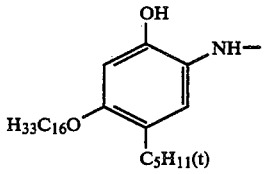

(R-3)

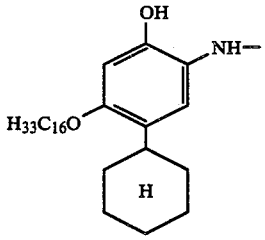

(R-4)

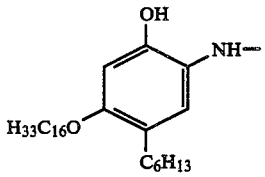

(R-5)

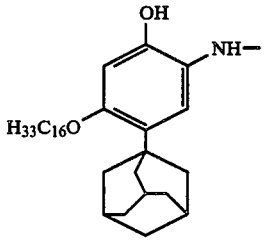

(R-6)

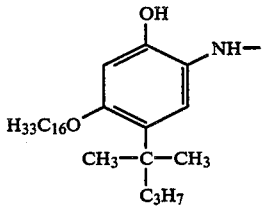

(R-7)

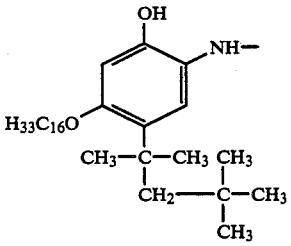

-continued (R-8)

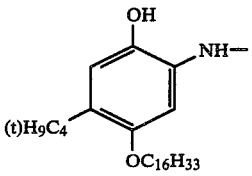

(R-9)

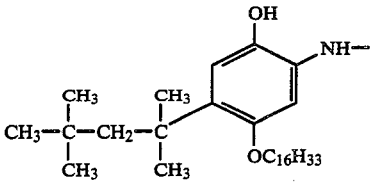

(R-10)

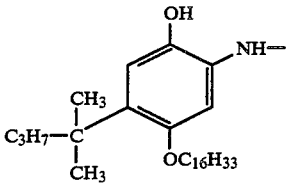

(R-11)

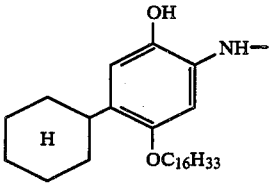

(R-12)

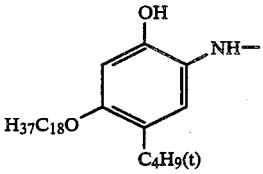

The dye portions represented by D are derived from an azo dye, an azomethine dye, an anthraquinone dye, a naphthoquinone dye, a styryl dye, a nitro group, a quinoline dye, a carbonyl dye, a phthalocyanine dye, and the like, and may be useful in a temporary blue shifted form which is capable of regenerating during the development processing. Representative examples of the dye portion to be released from the dye releasing compound are described in the above references, U.S. Pat. No. 4,500,626, columns 12–22. Particularly preferred are those compounds shown below.

Yellow Dye (D-1)

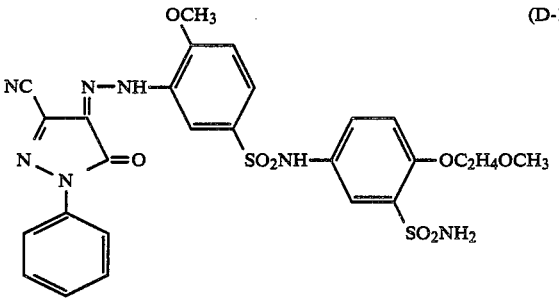

-continued (D-2)

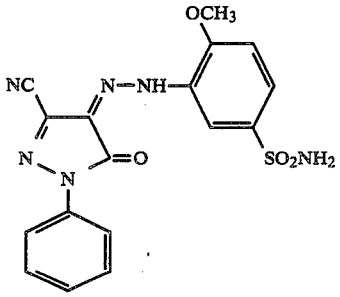

(D-3)

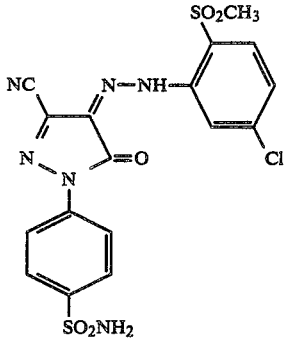

(D-4)

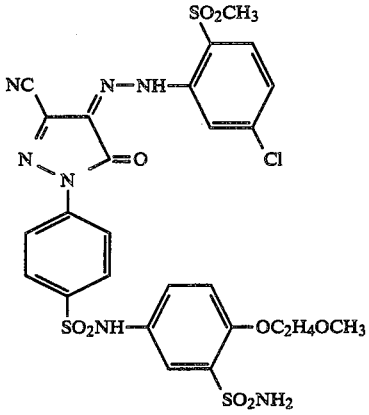

Magenta Dye (D-5)

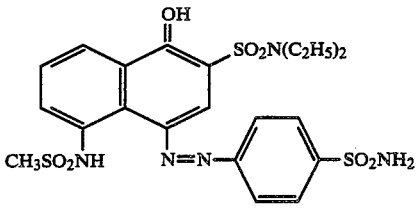

(D-6)

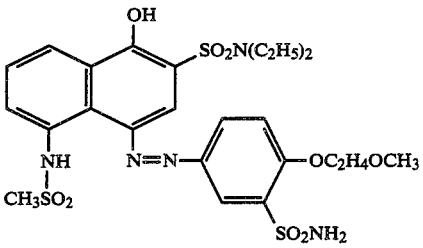

-continued

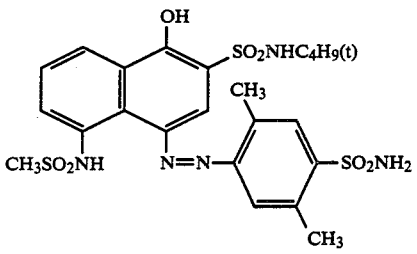

Cyan Dye (D-8)

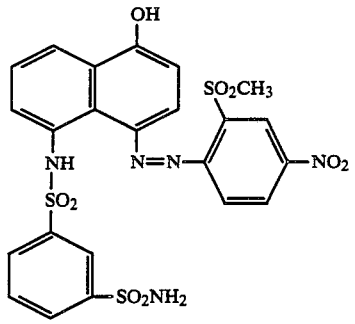

(D-9)

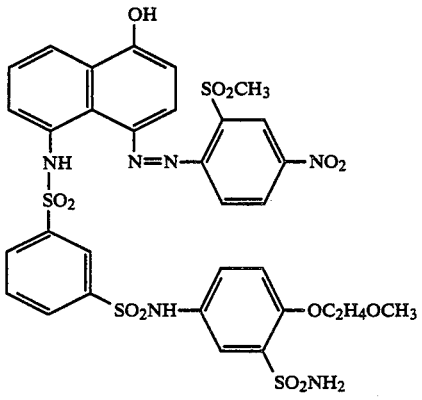

(D-10)

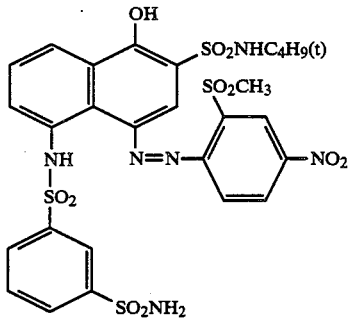

Representative examples of the dye releasing compound which can be used in the present invention include the compounds described in U.S. Pat. No. 4,500,626, columns 23–44. Of these compounds, Compounds (1) to (3), (10) to (13), (16) to (19), (28) to (30), (33), (35), (38) to (40), and (42) to (64) are preferred.

In addition, the following cyan and yellow dye releasing compounds are useful.

(D-7)

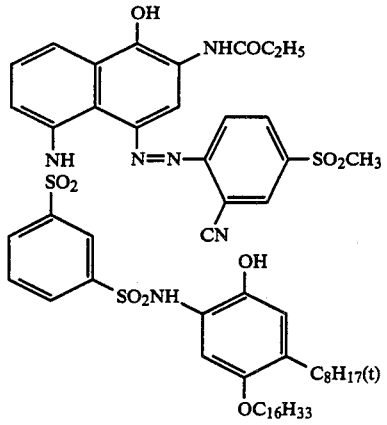

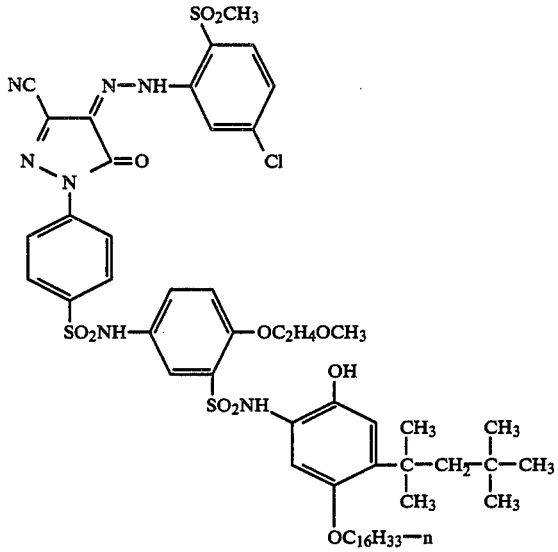

The amount of the dye releasing compound used is generally from about 0.01 to 4 mols, and preferably from about 0.03 to 1 mol, per mol of silver halide.

Silver halides which can be used include silver chloride, silver chlorobromide, silver chloroiodide, silver bromide, silver iodobromide, silver chloroiodobromide, and silver iodide.

Particularly preferred examples of silver halide are those compounds containing silver iodide crystals as part of the silver halide crystal particles. That is, compounds showing a pattern ascribable to pure silver iodide in an X-ray diffraction analysis are preferred.

In photographic light-sensitive materials, a silver halide containing two or more different halogen atoms is often used. In the usual silver halide emulsion, these silver halide particles are complete mixed crystals. In an X-ray diffraction analysis of such a silver iodobromide emulsion, for example, patterns ascribable to silver iodide and silver bromide crystals cannot be observed, but an X-ray pattern appears at a position intermediate between the patterns of the silver iodide and silver bromide patterns and corresponding to their mixing ratio.

Particularly preferred examples of silver halide which can be used in the present invention are those compounds containing silver iodide crystals as part of their crystal particles, i.e., silver chloroiodide, silver iodobromide, and silver chloroiodobromide, having an X-ray pattern ascribable to the pure silver iodide crystals in an X-ray diffraction analysis.

Silver iodobromide as an example of such a silver halide is prepared by first adding a silver nitrate solution to a potassium bromide solution to prepare silver bromide particles and then adding potassium iodide thereto.

The particle size of the silver halide is generally from 0.001 to 2 μm, and preferably from 0.001 to 1 μm.

The silver halide that is used in the present invention may be used as is or may be chemically sensitized with chemical sensitizers such as compounds of sulfur, selenium, tellurium, platinum, gold, palladium, rhodium, iridium, etc., reducing agents such as tin halide, or mixtures thereof.

In the light-sensitive material of the present invention, various dye releasing activators can be used. These dye releasing activators are compounds which are basic and are capable of accelerating development, or so-called nucleophilic compounds. Bases or base precursors are used.

The dye releasing activator can be incorporated in the light-sensitive material or a dye fixing material. In the case that the dye releasing activator is incorporated in the light-sensitive material, it is advantageous to use a base precursor.

Preferred bases include inorganic bases such as hydroxides, phosphates, borates, carbonates, quinolinates, and metaborates of alkali metals or alkaline earth metals; ammonium hydroxide; quaternary alkylammonium hydroxide; and other metal hydroxides, and organic bases such as aliphatic amines (e.g., trialkylamines, hydroxylamines, and aliphatic polyamines), aromatic amines (e.g, N-alkyl-substituted aromatic amines, N-hydroxyalkyl-substituted aromatic amines, and bis[p-(dialkylamino)phenyl]methanes), heterocyclic amines, amidines, cyclic amidines, guanidines, and cyclic guanidines. In addition, betaine iodated tetramethylammonium and diaminobutanedihydro chloride as described in U.S. Pat. No. 2,410,644 and amino acid-containing organic compounds such as 6-aminocaproic acid as described in U.S. Pat. No. 3,506,444 are useful. Particularly useful are those bases having a pKa of 8 or more.

Base precursors which are used are compounds which undergo a certain reaction on heating, thereby releasing a base, such as organic acid/base salts which undergo decarboxylation and are decomposed on heating, and compounds which are decomposed by Lossen rearrangement and Beckmann rearrangement, thereby releasing amine.

Preferred base precursors include the precursors of organic bases as described above. Examples are salts of heat decomposable organic acids such as trichloroacetic acid, trifluoroacetic acid, propiolic acid, cyanoacetic acid, sulfonylacetic acid, and acetoacetic acid, and salts of 2-carboxycarboxamide, as described in U.S. Pat. No. 4,088,496.

Further representative examples of these base precursors are shown below. Examples of compounds which are considered to release a base through decarboxylation of the acid portion are shown below.

Trichloroacetic acid derivatives include guanidinetrichloroacetic acid, piperidinetrichloroacetic acid, morpholinetrichloroacetic acid, p-toluidinetrichloroacetic acid, and 2-picolinetrichloroacetic acid.

In addition, base precursors as described in British Pat. No. 998,945, U.S. Pat. No. 3,220,846, and Japanese Patent Application (OPI) No. 22625/75 can be used.

Trichloroacetic acid-based precursors include the salts of compounds such as 2-carboxycarboxamide derivatives as described in U.S. Pat. No. 4,088,496, α-sulfonyl acetate derivatives as described in U.S. Pat. No. 4,060,420, and propiolic acid derivatives as described in Japanese Patent Application (OPI) No. 180537/84, and bases. In addition to organic base salts, those salts containing alkali metals and alkaline earth metals are useful. These salts are described in Japanese Patent Application (OPI) No. 195237/84.

Other useful precursors include hydroxamcarbamates as described in Japanese Patent Application (OPI) No. 168440/84, utilizing Lossen rearrangement, and aldoxime carbamates forming nitrile as described in Japanese Patent Application (OPI) No. 157637/84.

Amineimides as described in *Research Disclosure*, May, 1977, No. 15776, and aldonamides described in Japanese Patent Application (OPI) No. 22625/75, which decompose at high temperatures, thereby producing a base, are preferably used in the present invention.

The above-described bases or base precursors can be used not only for the purpose of accelerating the release of dye, but also for other purposes, such as for control of the pH value.

In the present invention, as described above, it is generally more effective to use the above base precursors in combination. Particularly preferred among the base precursors are the sodium, potassium, cesium, and guanidine salts of trichloroacetic acid, phenylsulfonylacetic acid, and phenylpropiolic acid.

In order to improve the storage stability of the light-sensitive material of the present invention, it is preferred to use reducing agents such as 3-pyrazolidone-based compounds in combination with the base precursors.

Representative examples of such 3-pyrazolidone-based compounds include 1-phenyl-3-pyrazolidone, 1-phenyl-4,4-dimethyl-3-pyrazolidone, 4-hydroxymethyl-4-methyl-1-phenyl-3-pyrazolidone, 1-m-tolyl-3-pyrazolidone, 1-p-tolyl-3-pyrazolidone, 1-phenyl-4-methyl-3-pyrazolidone, 1-phenyl-5-methyl-3-pyrazolidone, 1-phenyl-4,4-bis(hydroxymethyl)-3-pyrazolidone, 1,4-dimethyl-3-pyrazolidone, 4-methyl-3-pyrazolidone, 4,4-dimethyl-3-pyrazolidone, 1-(3-chlorophenyl)-4-methyl-3-pyrazolidone, 1-(4-chlorophenyl)-4-methyl-3-pyrazolidone, 1-(4-tolyl)-4-methyl-3-pyrazolidone, 1-(2-tolyl)-4-methyl-3-pyrazolidone, 1-(4-tolyl)-3-pyrazolidone, 1-(3-tolyl)-3-pyrazolidone, 1-(3-tolyl)-4,4-dimethyl-3-pyrazolidone, 1-(2-trifluoroethyl)-4,4-dimethyl-3-pyrazolidone, 5-methyl-3-pyrazolidone, 1-(4-tolyl)-4-hydroxymethyl-4-methyl-3-pyrazolidone, and 1-(3-tolyl)-4-hydroxymethyl-4-methyl-3-pyrazolidone.

The amount of the 3-pyrazolidone compound added is usually from about 0.01 to 20 mol per mol, and preferably from about 0.1 to 10 mol per mol of silver.

In the light-sensitive material of the present invention, it is preferred that one or more mercapto compounds be added as antifoggants. A preferred example of a mercapto compound is a compound having the following structure.

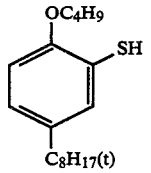

In the light-sensitive material of the present invention, in order to appropriately stop development, it is desirable that compounds releasing an acid on heating (acid precursors), such as oxime esters as described in Japanese Patent Application No. 216928/83 (corresponding to U.S. patent application Ser. No. 672,643, filed on Nov. 19, 1984), benzoic acid phenyl ester derivatives, and benzoic acid alkyl ester derivatives be added.

Binders which are used in the present invention can be used singly or in combination with each other. As the binders, hydrophilic ones are used. Typical examples of hydrophilic binders are transparent or translucent binders, including natural substances such as proteins (e.g., gelatin, gelatin derivatives, and cellulose derivatives), and polysaccharides (e.g., starch and gum arabic), and synthetic polymeric substances such as water-soluble polyvinyl compounds (e.g., polyvinyl pyrrolidone and acrylamide polymers). In addition, dispersible vinyl compounds can be used, in a latex form, and increase the dimensional stability of the light-sensitive material.

In the light-sensitive material of the present invention, compounds having an ability to achieve both activation of development and stabilization of images can be used. Preferable examples of such compounds include isothiuroniums, exemplified by 2-hydroxyethylisothiuronium trichloroacetate as described in U.S. Pat. No. 3,301,678, bisisothiuroniums such as 1,8-(3,6-dioxaoctane)bis(isothiuronium trichloroacetate) as described in U.S. Pat. No. 3,669,670, thiol compounds as described in West German Patent Laid-Open No. 2,162,714, thiazolium compounds such as 2-amino-2-thiazolium trichloroacetate and 2-amino-5-bromoethyl-2-thiazolium trichloroacetate as described in U.S. Pat. No. 4,012,260, and compounds containing α-sulfonyl acetate as an acid portion, such as bis(2-amino-2-thiazolium)methylenebis(sulfonylacetate), and 2-amino-2-thiazolium phenylsulfonylacetate as described in U.S. Pat. No. 4,060,420.

In addition, azole thioether and blocked azolein thion compounds as described in Belgian Pat. No. 768,071, 4-aryl-1-carbamyl-2-tetrazoline-5-thione compounds as described in U.S. Pat. No. 3,893,859, and compounds as described in U.S. Pat. Nos. 3,839,041, 3,844,788 and 3,877,940 are preferably used.

In a particularly preferred embodiment of the present invention, organic silver salt oxidizing agents are used in combination. These agents are silver salts relatively stable against light and, when heated to from 80° C. to 250° C., preferably from 100° C. to 250° C., in the presence of exposed silver halide, react with the above dye releasing compound or with the reducing agent which is, if desired, added along with the dye releasing compound, thereby producing a silver image. When these organic silver salt oxidizing agents are added in combination, the light-sensitive material of the present invention produces color images of higher density. The amount of the organic silver salt oxidizing agent added is generally from 0 to 100 mols, and preferably from 0.2 to 10 mols, per mol of silver halide.

Examples of useful organic silver salt oxidizing agents include silver salts of organic compounds containing a carboxyl group. Typical examples of these silver salts are aliphatic carboxylic acid silver salts and aromatic carboxylic acid silver salts. The aliphatic carboxylic acid silver salts include the silver salts of behenic acid, stearic acid, oleic acid, and lauric acid. In addition, the compounds described in U.S. Pat. No. 4,473,631 can be used.

In the light-sensitive material of the present invention, the above-described components can be introduced in a suitable point. For example, if necessary, one or more of the components can be introduced in one or more thin layers of the light-sensitive material. In some cases, it is desirable that the above-described reducing agent, image stabilizer, and/or other additives be incorporated in the protective layer in specified amounts or proportions. This may accelerate the movement of the additives from layer to layer in the light-sensitive material of the present invention.

The light-sensitive material of the present invention can be used for forming either negative images or positive images. Negative images or positive images are formed mainly depending on the type of the light-sensitive silver halide. In forming direct positive images, for example, internal latent image silver halide emulsions as described in U.S. Pat. Nos. 2,592,250, 3,206,313, 3,367,778 and 3,447,927, and mixtures of surface image silver halide emulsions as described in U.S. Pat. No. 2,996,382 and internal latent image silver halide emulsions can be used.

The light-sensitive material of the present invention can be exposed by various techniques. Upon exposure of the light-sensitive material to radiations, such as visible light, a latent image is formed. In this exposure process, ordinarily used light sources such as sunlight, a strobe light, a flash light, a tungsten lamp, a mercury lamp, a halogen lamp such as an iodine lamp, a xenon lamp, a laser ray, a CRT (cathode ray tube) light source, a fluorescent tube, and a light emitting diode can be used.

The light-sensitive material of the present invention is developed by heating. For this purpose, a hot plate, an iron, a hot roller, a heating means utilizing carbon or titanium white, etc., can be used. The heating temperature is appropriately from about 110° to 180° C.

A support for use in the preparation of the light-sensitive material of the present invention, or the dye fixing material which is used if desired must withstand the above processing temperature. As well as glass, paper, metal, and the like, an acetyl cellulose film, a cellulose ester film, a polyvinyl acetal film, a polystyrene film, a polycarbonate film, a polyethylene terephthalate film, and the like can be used. In addition, paper supports laminated with polymers such as polyethylene can be used. Polyester films, e.g., as described in U.S. Pat. Nos. 3,634,089 and 3,725,070, are preferably used in the present invention.

In developing the light-sensitive material of the present invention, as described above, it is only necessary to apply heating; it is not necessary to supply liquids such as water and alkaline aqueous solutions to the silver halide emulsion layer from the outside. Dye transferring activator can be used to make it easy for the dye compound released from the dye releasing compound after development to transfer from the silver halide emulsion layer to the dye fixing layer.

In a system to supply the dye transferring activator from the outside, if desired, water and aqueous solutions of caustic soda, caustic potash, and inorganic alkali metal salts are used. In addition, low boiling point solvents such as methanol, N,N-dimethylformamide, acetone, diisobutyl ketone, and the like, or mixtures of these low boiling point solvents and water or basic aqueous solutions are used. The dye transferring activator may be used in a procedure in which the dye fixing layer is wetted with the dye transferring activator.

When the dye transferring activator is introduced in the light-sensitive material or the dye fixing material, it is not necessary to supply the dye transferring activator from the outside. The dye transferring activator may be incorporated in the light-sensitive material in the form of crystalline water or microcapsules. In addition, it may be incorporated as a precursor which releases a solvent at elevated temperatures. A more preferred system is such that a hydrophilic heat solvent which is solid at ordinary room temperature (about 20° C.) and melts at elevated temperature is incorporated in the light-sensitive material or the dye fixing material. The hydrophilic heat solvent may be added to any one of the light-sensitive material and the dye fixing material, or both the materials. Moreover, it may be added to any of an emulsion layer, an interlayer, a protective layer, and a dye fixing layer. Preferably it is added to the dye fixing layer and/or a layer adjacent thereto.

Hydrophilic heat solvents which can be used include ureas, pyridines, amides, sulfonamides, imides, alcohols, oximes, and other heterocyclic compounds.

A dye fixing material which can be used in combination with the light-sensitive material of the present invention comprises a support with at least a dye fixing layer provided thereon, said dye fixing layer being capable of fixing therein the mobile dye released from the dye releasing compound. This dye fixing layer may be laminated in combination with the silver halide emulsion layer on the same surface of the support of the light-sensitive material. In this case, a unit containing the dye fixing layer can be separated from a unit containing the silver halide emulsion layer after development followed by dye transfer. The dye fixing material may be superposed on the light-sensitive material after exposure, or may be exposed in the state that both the materials are superposed.

The dye fixing layer can contain various mordants. Of these mordants, high molecular polymer mordants are preferred.

Representative examples of mordants and binders such as gelatin to be added to the dye fixing layer, and of a white reflection layer to be coated along with the dye fixing layer are described in U.S. Pat. No. 4,473,631.

The present invention is described in greater detail with reference to the following examples. In the examples, all percents are by weight unless otherwise indicated.

EXAMPLE 1

Preparation of Silver Iodobromide Emulsion 40 g of gelatin and 26 g of KBr were dissolved in 3,000 ml of water, and the resulting solution was stirred while maintaining it at 50° C.

A solution of 34 g of silver nitrate dissolved in 200 ml of water was added to the above solution for 10 minutes. Then, a solution of 3.3 g of KI dissolved in 100 ml of water was added to the solution for 2 minutes.

The thus formed emulsion was removed of excess salts. Subsequently the emulsion was adjusted to a pH of 6.0 to yield a silver iodobromide emulsion (yield, 400 g).

Preparation of Dispersion of Dye Releasing Compound in Gelatin 10 g of a dye releasing compound having the following formula

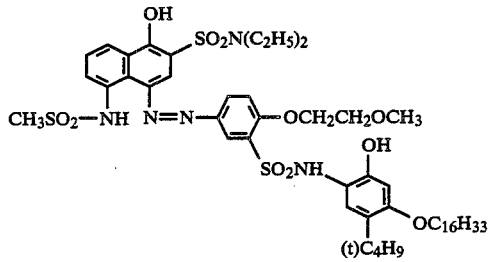

0.5 g of sodium 2-ethylhexyl succinate sulfonate as a surface active agent, and 20 g of tricresyl phosphate (TCP) were weighted out, and 30 ml of ethyl acetate was added thereto. They were then dissolved in the ethyl acetate by heating at about 60° C. The resulting solution was added to 100 g of a 10 wt% solution of gelatin, stirred, and dispersed for 10 minutes by means of a homogenizer at 10,000 rpm. The thus formed dispersion is hereafter referred to as the "dispersion of the dye releasing compound".

| Preparation of Light-Sensitive Coating | | |
|---|---|---|
| (a) | Light-sensitive silver iodobromide emulsion | 25 g |
| (b) | Dispersion of the dye releasing compound | 33 g |

-continued

| Preparation of Light-Sensitive Coating | | |
|---|---|---|
| (c) | 5% Aqueous solution of compound having the following formula | 10 ml |

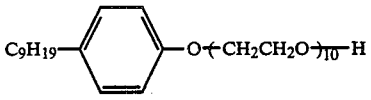

| | | |
|---|---|---|
| (d) | Solution of 1.5 g of guanidine trichloroacetic acid dissolved in 15 ml of ethanol | |
| (e) | Solution of 0.4 g of Compound (1) as described above, dissolved in 4 ml of methanol | |

The above ingredients (a) to (e) were mixed and dissolved by heating. The resulting solution was then coated on a 180 μm thick polyethylene terephthalate film in a wet thicknesss of 30 μm and dried. On the thus formed layer was further coated the following composition in a wet thickness of 25 μm to thereby form a protective layer.

| Composition of Protective Layer | |
|---|---|
| 10 wt % Aqueous solution of gelatin | 30 g |
| Water | 70 ml |

The above prepared light-sensitive material was dried and exposed imagewise for 10 seconds by the use of a tungsten lamp at 2,000 lux. The material was then uniformly heated for 20 seconds on a heat block maintained at 140° C. The resultant material is hereafter referred to as Sample 1-A.

Another light-sensitive material, Sample 1-B, was prepared in the same manner as above, excpet that as the ingredient (e), only 4 ml of methanol (not containing Compound (1)) was used. This material was processed in the same manner as above.

Preparation of Dye Fixing Material with Dye Fixing Layer 10 g of a methyl acrylate/N,N,N-trimethyl-N-vinylbenzylammonium chloride (1/1) copolymer was dissolved in 200 ml of water and then uniformly mixed with 100 g of 10 wt% lime-treated gelatin. The resulting mixture was uniformly coated in a wet thickness of 90 μm on a paper support laminated with polyethylene. The thus prepared material was dried and used as a dye fixing material.

The dye fixing material was dipped in water, and then removed from the water. The above heated light-sensitive materials, Sample 1-A and 1-B were superposed on separate pieces of the dye fixing material in such a manner that the coatings came into contact with each other. They were then heated for 6 seconds on a heat block maintained at 80° C. Then, the dye fixing material was separated from the light-sensitive material, whereupon a negative magenta dye image was formed on the dye fixing material. The density of the negative image was measured with a Macbeth transmission densitometer (TD-504). The results are shown in Table 1 below.

TABLE 1

| Sample | Maximum Density | Minimum Density |
|---|---|---|
| 1-A (Example of the Invention) | 2.10 | 0.20 |
| 1-B (Comparative Example) | 1.03 | 0.18 |

It can be seen from the results of Table 1 that if the sulfonamide compound of the present invention is used, the maximum density can be greatly increased without a substantial increase in the minimum density.

EXAMPLE 2

The procedure of Example 1 was repeated wherein each compound shown in Table 2 was used in place of Compound (1). The results are shown in Table 2.

TABLE 2

| Sample No. | Compound | Amount (g/4 ml of MeOH) | Maximum Density | Minimum Density |
|---|---|---|---|---|
| C (Example of the Invention) | Compound (6) | 0.40 | 2.25 | 0.22 |
| D (Example of the invention) | Compound (3) | " | 2.31 | 0.25 |
| E (Example of the invention) | Compound (12) | 0.60 | 2.11 | 0.19 |
| F (Example of the invention) | Compound (25) | 0.40 | 2.14 | 0.18 |
| G (Example of the invention) | Compound (13) | " | 2.22 | 0.21 |
| H (Example of the invention) | Compound (22) | " | 2.09 | 0.17 |
| I (Example of the invention) | Compound (10) | 0.60 | 2.02 | " |
| J (Example of the invention) | Compound (42) | 0.40 | 1.70 | 0.12 |
| K (Example of the invention) | Compound (43) | 0.60 | 1.77 | 0.15 |
| L (Example of the invention) | Compound (44) | 0.40 | 1.82 | " |
| M (Example of the invention) | Compound (48) | " | 1.91 | 0.18 |
| N (Example of the invention) | Compound (49) | " | 2.18 | 0.19 |
| Q (Comparative Example) | $CH_3SO_2NH_2$ | " | 1.01 | 0.12 |

TABLE 2-continued

| Sample No. | Compound | Amount (g/4 ml of MeOH) | Maximum Density | Minimum Density |
|---|---|---|---|---|
| P (Comparative Example) | 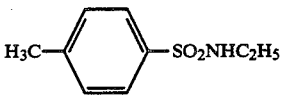 | " | 0.80 | 0.09 |

It can be seen from the results of Table 2 that if the sulfonamide compounds of the present invention are used, the maximum density can be greatly increased without a substantial increase in the minimum density as compared with Comparative Examples in which the sulfonamide compounds not falling within the scope of the present invention are used.

EXAMPLE 3

Dye releasing compound dispersions were prepared in the same manner as in Example 1, except that in place of the dye releasing compound of Example 1, substances having the following formulae were each used in an amount of 10 g each.

Dispersion A

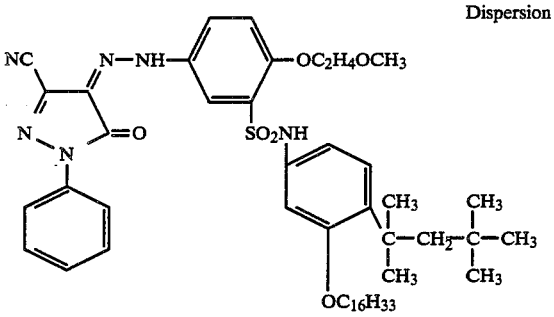

Dispersion B

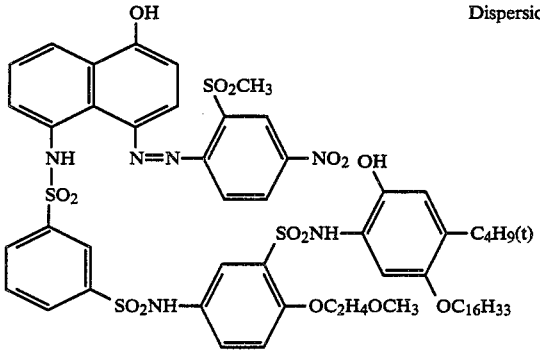

The dispersions containing the former and latter substances are referred to as Dispersions A and B, respectively.

Thereafter, the same procedure as in Example 1 was repeated. The results are shown in Table 3.

TABLE 3

| Dye Releasing Compound Dispersion | Compound (1) | Maximum Density | Minimum Density |
|---|---|---|---|
| Dispersion A | Containing | 1.20 | 0.12 |
| | Not containing | 0.65 | 0.11 |
| Dispersion B | Containing | 2.26 | 0.23 |

TABLE 3-continued

| Dye Releasing Compound Dispersion | Compound (1) | Maximum Density | Minimum Density |
|---|---|---|---|
| | Not containing | 1.15 | 0.20 |

It can be seen from the results of Table 3 that the sulfonamide compounds of the present invention provide a very high maximum density.

EXAMPLE 4

Preparation of Emulsion 6.5 g of benzotriazole and 10 g of gelatin were dissolved in 1,000 ml of water, and the resulting solution was stirred while maintaining it at 50° C. A solution of 8.5 g of silver nitrate dissolved in 100 ml of water was added to the above solution for 2 minutes.

A solution of 1.2 g of potassium bromide dissolved in 50 ml of water was added to the above solution for 2 minutes. The thus formed emulsion was removed of excess salts. Then, the emulsion was ajusted to pH 6.0 (yield, 200 g).

| Preparation of Light-Sensitive Coating | | |
|---|---|---|
| (a) | Benzotriazole silver emulsion containing light-sensitive silver bromide | 10 g |
| (b) | Dye releasing compound dispersion (same as used in Example 1) | 3.5 g |
| (c) | Solution of 0.35 g of a compound having the formula shown below in 3 ml of a water/ethanol (50/50 by volume) mixture | |
| | 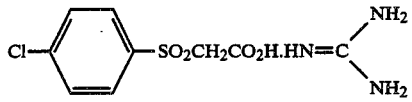 | |
| (d) | 5 wt % Aqueous solution of a compound having the following formula | 1.5 ml |
| | 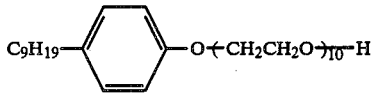 | |
| (e) | Solution of 0.2 g of compound (3) of the present invention dissolved in 4 ml of water | |

The above ingredients (a) to (e) were mixed. Thereafter the same procedure as in Example 1 was repeated. The results are shown in Table 4 below.

TABLE 4

| Sample | Maximum Density | Minimum Density |
|---|---|---|
| Containing Compound (3) (Example of the Invention) | 2.03 | 0.20 |
| Not containing Compound (3) (Comparative Example) | 1.10 | 0.18 |

It can be seen from the results of Table 4 that if the sulfonamide compound of the present invention is used, a high maximum density can be obtained.

EXAMPLE 5

The same emulsion as in Example 4 was prepared.

A dye releasing compound dispersion was prepared in the same manner as in Example 1, wherein 10 g of a substance having the following formuls as a dye releasing compound was used.

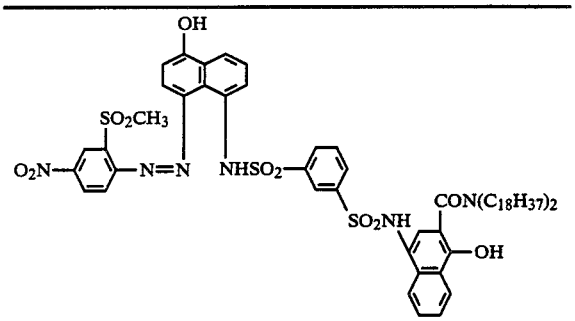

| | | |
|---|---|---|
| (a) | Benzotriazole silver emulsion containing light-sensitive silver bromide (same as used in Example 4) | 10 g |
| (b) | Dye releasing compound dispersion | 3.5 g |
| (c) | Solution of 0.3 g of compound (7) dissolved in 4 ml of ethanol | |
| (d) | Solution of 0.2 g of a compound having the formula as shown below in 4 ml of water | |

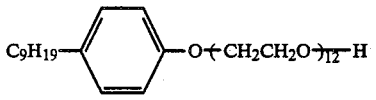

The above ingredients (a) to (d) were mixed and then dissolved by heating. The resulting solution was coated on a 180 μm thick polyethylene terephthalate film in a wet thickness 30 μm. The thus produced light-sensitive material was dried and then exposed imagewise by the use of a tungsten lamp at 2,000 lux for 10 seconds. The material was then uniformly heated for 30 seconds on a heat block maintained at 160° C. This material is Sample 5-A.

Another light-sensitive material, Sample 5-B, was prepared in the same manner as above, except that as the ingredient (c), only 4 ml of ethanol was used; Compound (7) was not added. This material was processed in the same manner as above.

A dye fixing material was prepared in the same manner as in Example 1. Thereafter, the same procedure as in Example 1 was repeated. The results are shown in Table 5 below.

TABLE 5

| Sample | Maximum Density | Minimum Density |
|---|---|---|
| 5-A (Example of the Invention) | 1.50 | 0.28 |
| 5-B (Comparative Example) | 0.85 | 0.22 |

It can be seen from the results of Table 5 that if the sulfonamide compound of the present invention is used, the maximum density is greatly increased compared with a case in which it is not used.

While the invention has been described in detail and with reference to specific embodiments thereof, it will be apparent to one skilled in the art that various changes and modifications can be made therein without departing from the spirit and scope thereof.

What is claimed is:

1. A heat developable color photographic light-sensitive material comprising (1) a light-sensitive silver halide, (2) a hydrophilic binder, (3) a dye releasing compound having an ability to reduce exposed light-sensitive silver halide and capable of reacting with the exposed silver halide upon heating, thereby releasing a mobile dye, and (4) a non-dye releasing development accelerating sulfonamide compound represented by formula ($I_0$)

$$R_0—SO_2NH_2 \qquad (I_0)$$

wherein $R_0$ represents an alkyl group, an alkenyl group, an alkynyl group containing at least 4 carbon atoms, an aralkyl group, an aryl group, or a heterocyclic ring group, provided that the heterocyclic ring group is linked to $—SO_2NH_2$ through a carbon atom contained in the ring thereof.

2. A heat developable color photographic light-sensitive material as in claim 1, wherein the sulfonamide compound is incorporated in a layer containing light-sensitive silver halide.

3. A heat developable color photographic light-sensitive material as in claim 1, wherein the sulfonamide compound is incorporated in a layer adjacent to a layer containing light-sensitive silver halide.

4. A heat developable color photographic light-sensitive material as in claim 1, wherein the sulfonamide compound is used in an amount of from 1/20 to 2 mols per mol of silver.

5. A heat developable color photographic light-sensitive material as in claim 2, wherein the sulfonamide compound is used in an amount of from 1/20 to 2 mols per mol of silver.

6. A heat developable color photographic light-sensitive material as in claim 3, wherein the sulfonamide compound is used in an amount of from 1/20 to 2 mols per mol of silver.

* * * * *